US011048192B1

(12) United States Patent
Toyota et al.

(10) Patent No.: US 11,048,192 B1
(45) Date of Patent: Jun. 29, 2021

(54) IMAGE FORMING APPARATUS CAPABLE OF SUPPRESSING OCCURRENCE OF IMAGE DEFECTS IN RESPONSE TO DIFFERENCE IN CARRIER RESISTANCE AND OBTAINING HIGH IMAGE QUALITY

(71) Applicant: KYOCERA Document Solutions Inc., Osaka (JP)

(72) Inventors: Yuji Toyota, Osaka (JP); Yasuhiro Tauchi, Osaka (JP); Masashi Fujishima, Osaka (JP); Norio Kubo, Osaka (JP); Akira Matayoshi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/113,063

(22) Filed: Dec. 6, 2020

(30) Foreign Application Priority Data

Dec. 6, 2019 (JP) ..... JP2019-221147

(51) Int. Cl.
*G03G 15/08* (2006.01)
*G03G 15/09* (2006.01)
*G03G 15/06* (2006.01)

(52) U.S. Cl.
CPC ..... *G03G 15/0907* (2013.01); *G03G 15/065* (2013.01); *G03G 15/0808* (2013.01)

(58) Field of Classification Search
CPC ..... G03G 15/065; G03G 15/0907
USPC ..... 399/55, 270
See application file for complete search history.

(56) References Cited

U.S. PATENT DOCUMENTS 8,626,039 B2 * 1/2014 Aoki et al. ..... G03G 15/065 399/270

FOREIGN PATENT DOCUMENTS

JP 2006-184475 A 7/2006

* cited by examiner

*Primary Examiner* — William J Royer
(74) *Attorney, Agent, or Firm* — Hawaii Patent Services; Nathaniel K. Fedde; Kenton N. Fedde

(57) ABSTRACT

Provided is an image forming apparatus capable of suppressing the occurrence of image defects in response to a difference in carrier resistance and obtaining high image quality. A developing unit has a developing roller that carries toner in a two-component developer that includes a toner and a magnetic carrier on the surface thereof, and forms a toner image on the surface of a photosensitive drum. A current detecting unit detects developing current flowing between the developing roller and the photosensitive drum when a developing voltage is applied to the developing roller by a developing power supply. When the developing voltage is applied to the photosensitive drum, a control unit derives a carrier resistance based on the developing current detected by a current detecting unit, and controls an AC amplitude of an AC voltage of the developing voltage based on the carrier resistance.

5 Claims, 6 Drawing Sheets

IMAGE FORMING APPARATUS CAPABLE OF SUPPRESSING OCCURRENCE OF IMAGE DEFECTS IN RESPONSE TO DIFFERENCE IN CARRIER RESISTANCE AND OBTAINING HIGH IMAGE QUALITY

INCORPORATION BY REFERENCE

This application is based on and claims the benefit of priority from Japanese Patent Application No. 2019-221147 filed on Dec. 6, 2019, the contents of which are hereby incorporated by reference.

BACKGROUND

The present disclosure relates to an image forming apparatus.

In electrophotographic image forming apparatuses such as copiers, printers, and the like, apparatuses in which toner is adhered to an electrostatic latent image that is formed on the surface of an photosensitive drum as an image carrier and developed, whereby a toner image to be transferred later to paper is formed, are widely used. An example of a typical image forming apparatus capable of stably forming a high-quality image is disclosed.

A typical disclosed image forming apparatus uses a carrier having a specified particle size and saturation magnetization, a developer amount regulating member having rigidity and a magnetic property, and a developer carrier having a plurality of grooves extending in the width direction, and the normal direction magnetic flux density of the surface portion of the developer carrier on which the developer amount regulating member faces is set within a predetermined range. As a result, image unevenness or the like due to a change in the amount of developer on the developer carrier may be suppressed, and a high-quality image may be stably formed.

SUMMARY

In order to solve the problems described above, the image forming apparatus according to the present disclosure includes an image carrier, a charging unit, a developing unit, a developing power supply, a current detecting unit, and a control unit. The image carrier has a photosensitive layer and an electrostatic latent image being formed on a surface thereof. The charging unit charges the surface of the image carrier. The developing unit has a developer carrier that carries toner in a two-component developer that includes a toner and a magnetic carrier on the surface thereof, and forms a toner image by adhering the toner to the electrostatic latent image that is formed on the image carrier. The developing power supply applies a developing voltage obtained by superimposing an AC voltage on a DC voltage to the developer carrier. The current detecting unit detects a developing current that flows between the developer carrier and the image carrier when the developing voltage is applied to the developer carrier. The control unit controls the operation of the image carrier, the charging unit, the developing unit, and the developing power supply. The control unit causes the charging unit to charge the surface of the image carrier, and when the developing voltage is applied to the developer carrier by the developing power supply, derives a carrier resistance based on the developing current detected by the current detecting unit, and controls an AC amplitude of the AC voltage based on the carrier resistance.

DETAILED DESCRIPTION

Hereinafter, embodiments according to the present disclosure will be described with reference to the drawings. Note that the present disclosure is not limited to the following contents.

Figure 1:
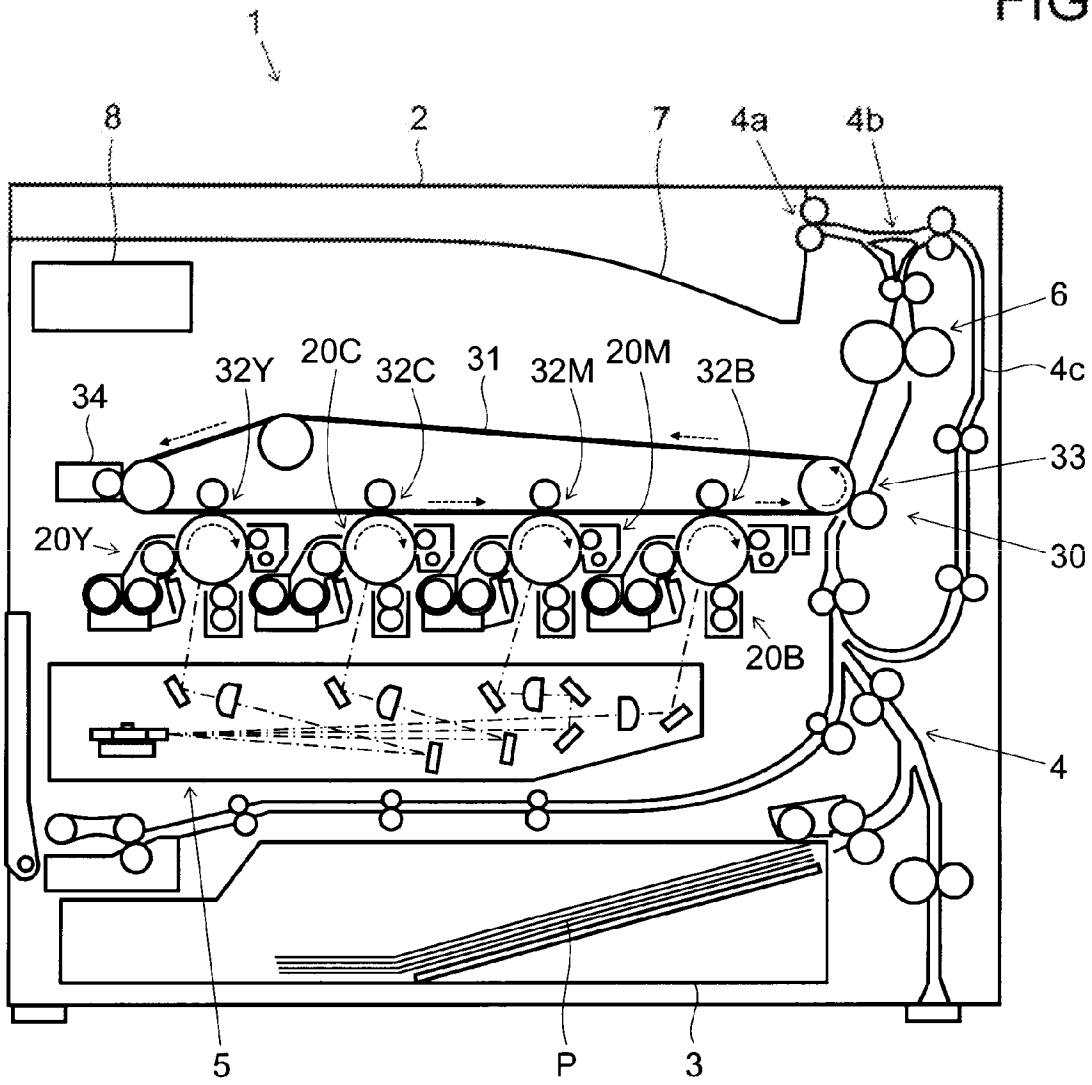
FIG. 1 is a schematic cross-sectional view illustrating a configuration of an image forming apparatus of an embodiment according to the present disclosure.
Figure 2:
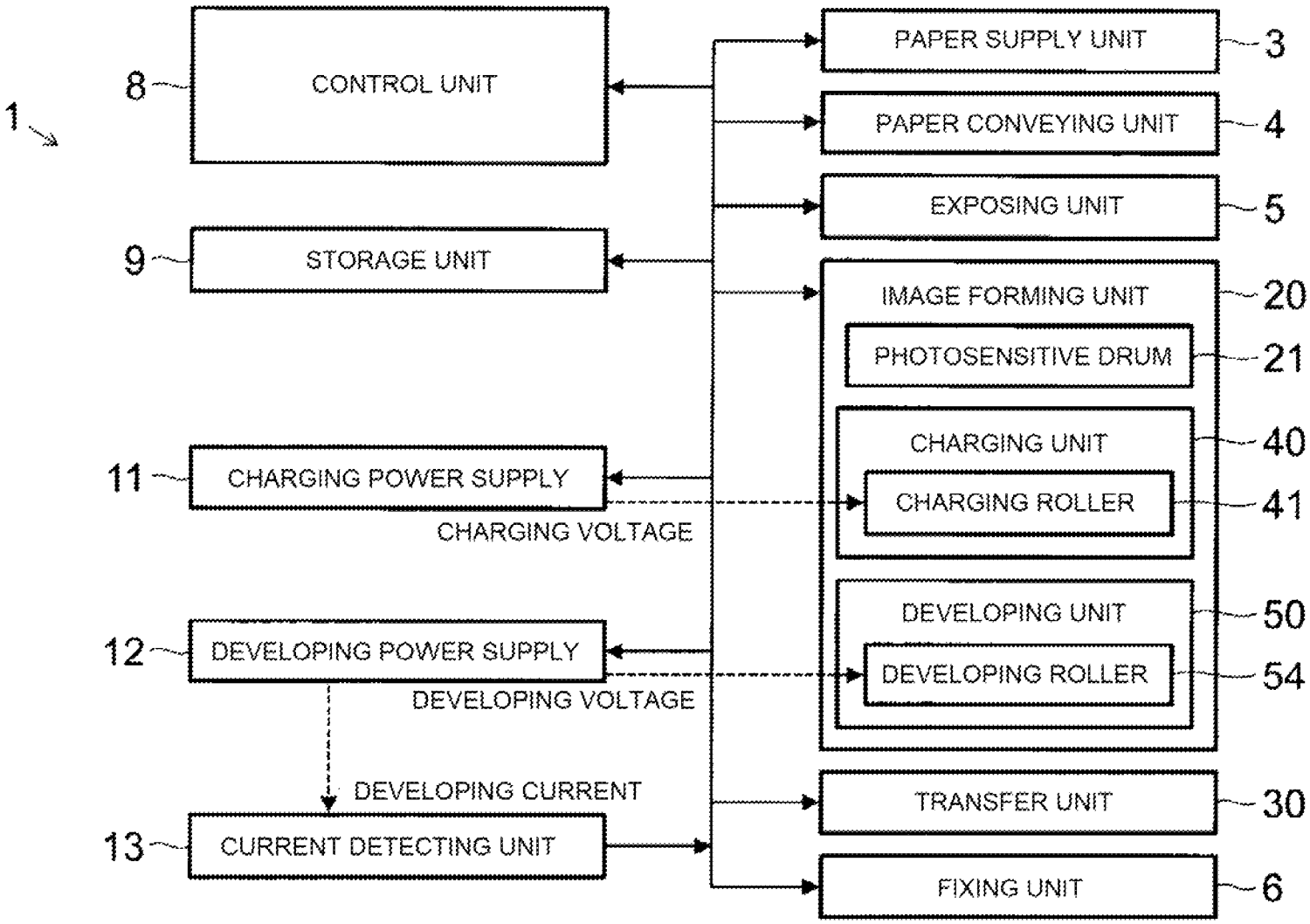
FIG. 2 is a block diagram illustrating a configuration of an image forming apparatus of an embodiment according to the present disclosure.
Figure 3:
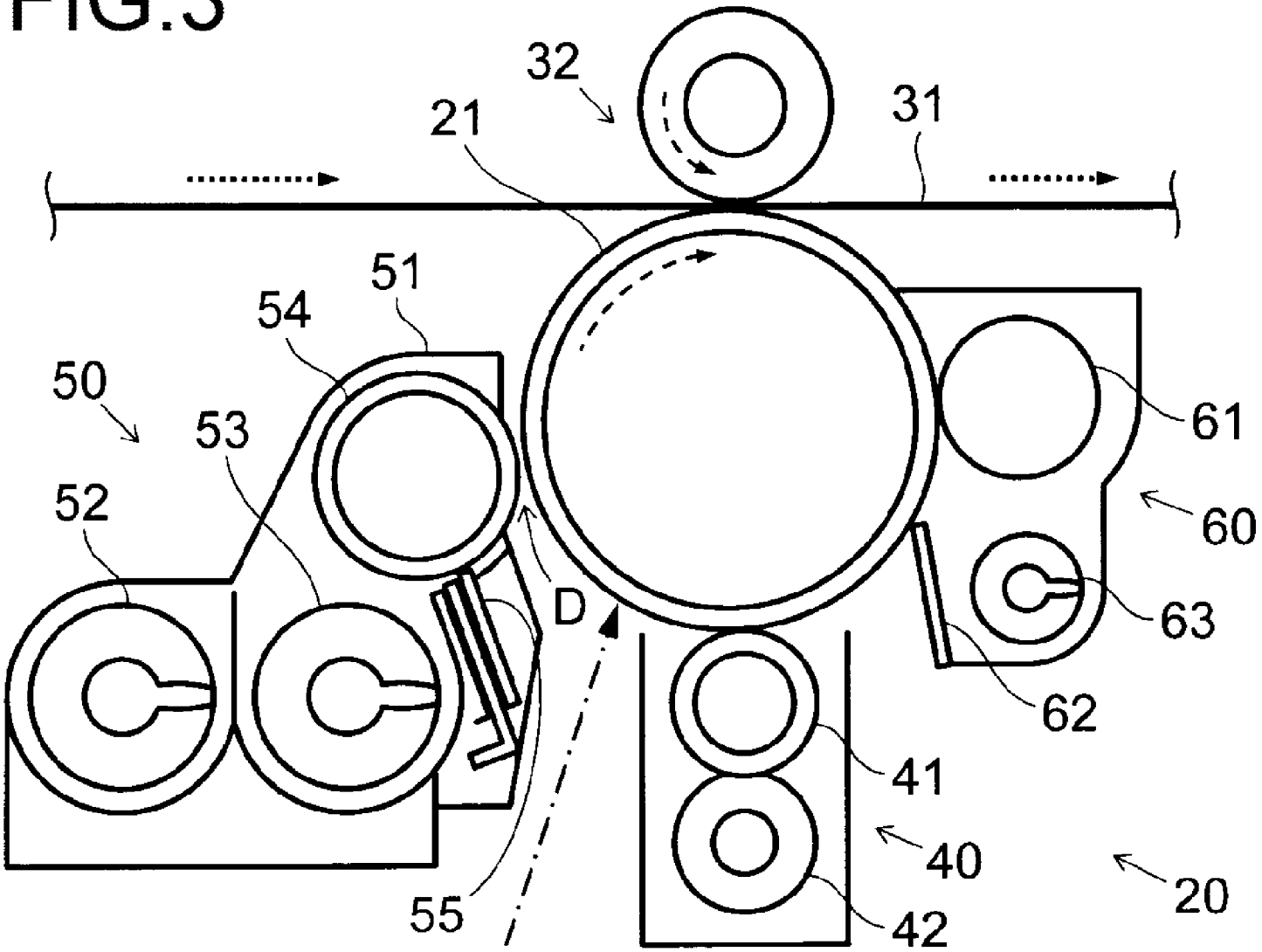
FIG. 3 is a cross-sectional view illustrating the periphery of an image forming unit of an image forming apparatus of an embodiment according to the present disclosure.

FIG. 1 is a schematic cross-sectional view illustrating a configuration of an image forming apparatus 1. FIG. 2 is a block diagram illustrating the configuration of the image forming apparatus 1. FIG. 3 is a cross-sectional view illustrating the periphery of an image forming unit 20 of the image forming apparatus 1. An example of the image forming apparatus 1 of the present embodiment is a tandem color printer that transfers a toner image onto paper P using an intermediate transfer belt 31. The image forming apparatus 1 may be a so-called multifunction machine having functions such as printing (printing), scanning (image reading), facsimile transmission and the like.

As illustrated in FIGS. 1 and 2, the image forming apparatus 1 includes a paper supply unit 3, a paper conveying unit 4, an exposing unit 5, an image forming unit 20, a transfer unit 30, a fixing unit 6, a paper discharge unit 7, a control unit 8, and a storage unit 9 that are provided in a main body 2.

The paper supply unit 3 accommodates a plurality of sheets of paper P, and separates and feeds out the paper P one sheet at the time of printing. The paper conveying unit 4 conveys the paper P fed from the paper supply unit 3 to a secondary transfer unit 33 and the fixing unit 6, and further discharges the paper P after fixing from a paper discharge port 4*a* to the paper discharge unit 7. In a case of performing double-sided printing, the paper conveying unit 4 sorts the paper P after fixing on the first side to a reverse conveying unit 4*c* by a branch unit 4*b*, and the paper P is again conveyed to the secondary transfer unit 33 and the fixing unit 6. The exposing unit 5 irradiates the image forming unit 20 with a laser beam that is controlled based on the image data.

The image forming unit 20 is arranged below the intermediate transfer belt 31. The image forming unit 20 includes an image forming unit 20Y for yellow, an image forming unit 20C for cyan, an image forming unit 20M for magenta, and an image forming unit 20B for black. These four image forming units 20 have the same basic configuration. Accordingly, in the following description, the identification symbols of "Y", "C", "M", and "B" representing each color may be omitted unless it is particularly necessary to limit them.

The image forming unit 20 includes a photosensitive drum (image carrier) 21 that is rotatably supported so as to be able to rotate in a specific direction (clockwise in FIGS. 1 and 3). The image forming unit 20 further includes a charging unit 40, a developing unit 50, and a drum cleaning unit 60 around the photosensitive drum 21 along the rotation direction thereof. Note that a primary transfer unit 32 is arranged between the developing unit 50 and the drum cleaning unit 60.

The charging unit 40 charges the surface of the photosensitive drum 21 to a specific potential. Then, an electrostatic latent image of a document image is formed on the surface of the photosensitive drum 21 by the laser beam emitted from the exposing unit 5. The developing unit 50 adheres toner to the electrostatic latent image and develops the toner to form a toner image. Each of the four image forming units 20 forms a toner image of a different color.

The transfer unit 30 includes an intermediate transfer belt 31, a primary transfer unit 32Y, 32C, 32M, 32B, a secondary transfer unit 33, and a belt cleaning unit 34. The intermediate transfer belt 31 is arranged above the four image forming units 20. The intermediate transfer belt 31 is an intermediate transfer body that is rotatably supported so as to rotate in a specific direction (counterclockwise in FIG. 1) and on which toner images formed by each of the four image forming units 20 are sequentially superimposed and primarily transferred. The four image forming units 20 are arranged in a so-called tandem method, in a row from the upstream side to the downstream side in the rotation direction of the intermediate transfer belts 31.

The primary transfer units 32Y, 32C, 32M, 32B are arranged above the image forming units 20Y, 20C, 20M, 20B of each color with the intermediate transfer belt 31 located therebetween. The secondary transfer unit 33 is arranged further on the upstream side in the paper conveying direction of the paper conveying unit 4 than the fixing unit 6, and is arranged further on the downstream side in the rotation direction of the intermediate transfer belt 31 of the transfer unit 30 than the image forming units 20Y 20C, 20M, 20B of each color. A belt cleaning unit 34 is arranged further on the upstream side in the rotation direction of the intermediate transfer belt 31 than the image forming units 20Y, 20C, 20M, 20B of each color.

The toner image is primarily transferred to the outer peripheral surface of the intermediate transfer belt 31 by the primary transfer units 32Y, 32C, 32M, 32B of each color. Then, as the intermediate transfer belt 31 rotates, the toner images of the four image forming units 20 are continuously superimposed and transferred to the intermediate transfer belt 31 at a specific timing. As a result, a color toner image in which four color toner images of yellow, cyan, magenta, and black are superimposed is formed on the outer peripheral surface of the intermediate transfer belt 31. The drum cleaning unit 60 cleans by removing toner and the like remaining on the surface of the photosensitive drum 21 after the primary transfer.

The color toner image on the outer peripheral surface of the intermediate transfer belt 31 is transferred to the paper P synchronously by the paper conveying unit 4 by a secondary transfer nip unit formed on the secondary transfer unit 33. The belt cleaning unit 34 cleans by removing toner and the like remaining on the outer peripheral surface of the intermediate transfer belt 31 after the secondary transfer.

The fixing unit 6 heats and pressurizes the paper P on which the toner image is transferred to fix the toner image on the paper P.

The control unit 8 includes a CPU, an image processing unit, other electronic circuits and electronic components. The CPU controls the operation of each component provided in the image forming apparatus 1 based on the control program or data stored in the storage unit 9, and performs processing related to the function of the image forming apparatus 1. Each of the paper supply unit 3, the paper conveying unit 4, the exposing unit 5, the image forming unit 20, the transfer unit 30, and the fixing unit 6 receives commands individually from the control unit 8 and performs printing on the paper P in conjunction with each other. Moreover, the control unit 8 is able to obtain an output value from a current detecting unit 13 described later.

The storage unit 9 is configured by combining a non-volatile storage device such as a program ROM (Read Only Memory), a data ROM, and the like and a volatile storage device such as a RAM (Random Access Memory).

Subsequently, the configuration of the image forming unit 20 and the surroundings thereof will be described with reference to FIGS. 2 and 3. Note that the image forming unit 20 of each color has the same basic structure, so the identification code representing each color is omitted.

The image forming unit 20 includes a photosensitive drum 21, a charging unit 40, a developing unit 50, and a drum cleaning unit 60 illustrated in FIGS. 2 and 3. Furthermore, the image forming apparatus 1 includes a charging power supply 11, a developing power supply 12, and a current detecting unit 13.

The photosensitive drum 21 is rotatably supported with the center axis thereof horizontal, and is rotated at a constant speed around the axis by a driving unit. The photosensitive drum 21 has a photosensitive layer made of an inorganic photosensitive body such as amorphous silicon (a-Si) or the like on the surface of a metal drum tube such as aluminum or the like. An electrostatic latent image is formed on the surface of the photosensitive drum 21.

The charging unit 40 has, for example, a charging roller 41 and a charge cleaning roller 42.

The charging roller 41 is rotatably supported with the center axis thereof being horizontal, and by coming into contact with the surface of the photosensitive drum 21, the charging roller 41 rotates according to the rotation of the photosensitive drum 21. The charging roller 41 has, for example, a conductive layer made of crosslinked rubber or the like including an ionic conductive material on the surface of a metal core. When a specific charging voltage is applied to the charging roller 41 that comes into contact with the surface of the photosensitive drum 21 so as to be driven and rotated, the surface of the photosensitive drum 21 is uniformly charged. The charge cleaning roller 42 comes into contact with the surface of the charging roller 41 and cleans the surface of the charging roller 41.

The charging roller 41 is electrically connected to the charging power supply 11. The charging power supply 11 has an AC constant voltage power supply and a DC constant voltage power supply. The AC constant voltage power supply outputs a sinusoidal AC voltage generated from a low-voltage DC voltage modulated in a pulse shape using a step-up transformer. The DC constant voltage power supply outputs a DC voltage obtained by rectifying a sinusoidal AC voltage generated from a low-voltage DC voltage modulated in a pulse shape using a step-up transformer. The charging power supply 11 generates a charging voltage obtained by superimposing the AC voltage (AC component) outputted from the AC constant voltage power supply onto the DC voltage (DC component) outputted from the DC constant voltage power supply, and applies the charging voltage to the charging roller 41.

The developing unit 50 includes a developing container 51, a first stirring and conveying member 52, a second stirring and conveying member 53, a developing roller (developer carrier) 54, and a regulating member 55.

The developing container 51 stores, for example, a two-component developer that includes toner and a magnetic carrier as a developer to be supplied from the developing unit 50 to the surface of the photosensitive drum 21. The first stirring and conveying member 52 and the second stirring and conveying member 53 are arranged inside the developing container 51. The first stirring and conveying member 52 and the second stirring and conveying member 53 are supported by the developing container 51 so as to be rotatable around an axis extending parallel to the photosensitive drum 21. In addition, the first stirring and conveying member 52 and the second stirring and conveying member 53 rotates around the axis, whereby the developer is conveyed while being stirred in the direction of the rotation axis. The toner is circulated and charged inside the developing container 51.

The developing roller 54 is supported by the developing container 51 so as to be rotatable around an axis extending parallel to the photosensitive drum 21. The developing roller 54 has, for example, a cylindrical shaped developing sleeve that rotates counterclockwise in FIG. 3, and a developing roller-side magnetic pole that is fixed in the developing sleeve. The developing roller 54 carries toner to be adhered to the surface of the photosensitive drum 21 in a developing region facing the photosensitive drum 21.

The developing roller 54 is electrically connected to the developing power supply 12. The configuration and operation of the developing power supply 12 is the same as the configuration and operation of the charging power supply 11. The developing power supply 12 generates a developing voltage obtained by superimposing the AC voltage (AC component) outputted from the AC constant voltage power supply onto the DC voltage (DC component) outputted from the DC constant voltage power supply, and applies the developing voltage to the developing roller 54.

The regulating member 55 is arranged on the upstream side in the rotation direction of the developing roller 54 in the developing region where the developing roller 54 and the photosensitive drum 21 face each other. The regulating member 55 is arranged close to the developing roller 54 and so that there is a specific gap between the tip end thereof and the surface of the developing roller 54. The regulating member 55 regulates the layer thickness of the developer passing through the gap between the tip end thereof and the surface of the developing roller 54.

The developer is stirred, circulated and charged by the first stirring and conveying member 52 and the second stirring and conveying member 53 in the developing container 51, and is carried on the surface of the developing roller 54. The layer thickness of the developer supported on the surface of the developing roller 54 is regulated by the regulating member 55. On the surface of the developing roller 54, a magnetic brush composed of toner and a magnetic carrier is formed. When a specific developing voltage is applied to the developing roller 54, the toner carried on the surface of the developing roller 54 flies to the surface of the photosensitive drum 21 in the developing region due to the potential difference between the surface potential of the photosensitive drum 21 and the developing roller 54, and the electrostatic latent image on the surface of the photosensitive drum 21 is developed.

The drum cleaning unit 60 has a cleaning roller 61, a cleaning blade 62, and a recovery spiral 63.

The cleaning roller 61 comes into contact with the surface of the photosensitive drum 21 at a specific pressure, and is rotated in a direction in which the contact region with the photosensitive drum 21 is moved in the same direction as the photosensitive drum 21 by the driving unit. The cleaning blade 62 comes into contact with the surface of the photosensitive drum 21 at a specific pressure. The cleaning roller 61 and the cleaning blade 62 clean by removing toner and the like remaining on the surface of the photosensitive drum 21 after the primary transfer. The recovery spiral 63 conveys the waste toner or the like removed from the surface of the photosensitive drum 21 to a waste toner recovery container provided outside the drum cleaning unit 60.

The operations of the photosensitive drum 21, the charging unit 40, the developing unit 50, the drum cleaning unit 60, the charging power supply 11, and the developing power supply 12 are controlled by the control unit 8.

The current detecting unit 13 is able to detect the developing current flowing between the developing roller 54 and the photosensitive drum 21 when the developing voltage is applied to the developing roller 54.

In developing a toner image using a two-component developer, the developing current is composed of a toner transfer current and a carrier current. The toner transfer current is a current that flows by the toner moving between the developing roller 54 and the photosensitive drum 21. The toner transfer current has a correlation with the amount of toner that moves between the developing roller 54 and the photosensitive drum 21, and increases as the amount of toner that moves increases. The carrier current is a current that flows in a state where development with toner is mostly not performed.

The direction in which the developing current flows is determined by the potential difference between the potential of the developing roller 54 and the surface potential of the photosensitive drum 21. In other words, when the potential of the developing roller 54 is higher than the surface potential of the photosensitive drum 21, the developing current flows from the developing roller 54 toward the photosensitive drum 21. Then, when the potential of the developing roller 54 is lower than the surface potential of the photoconductor drum 21, the developing current flows from the photosensitive drum 21 toward the developing roller 54.

Figure 4:
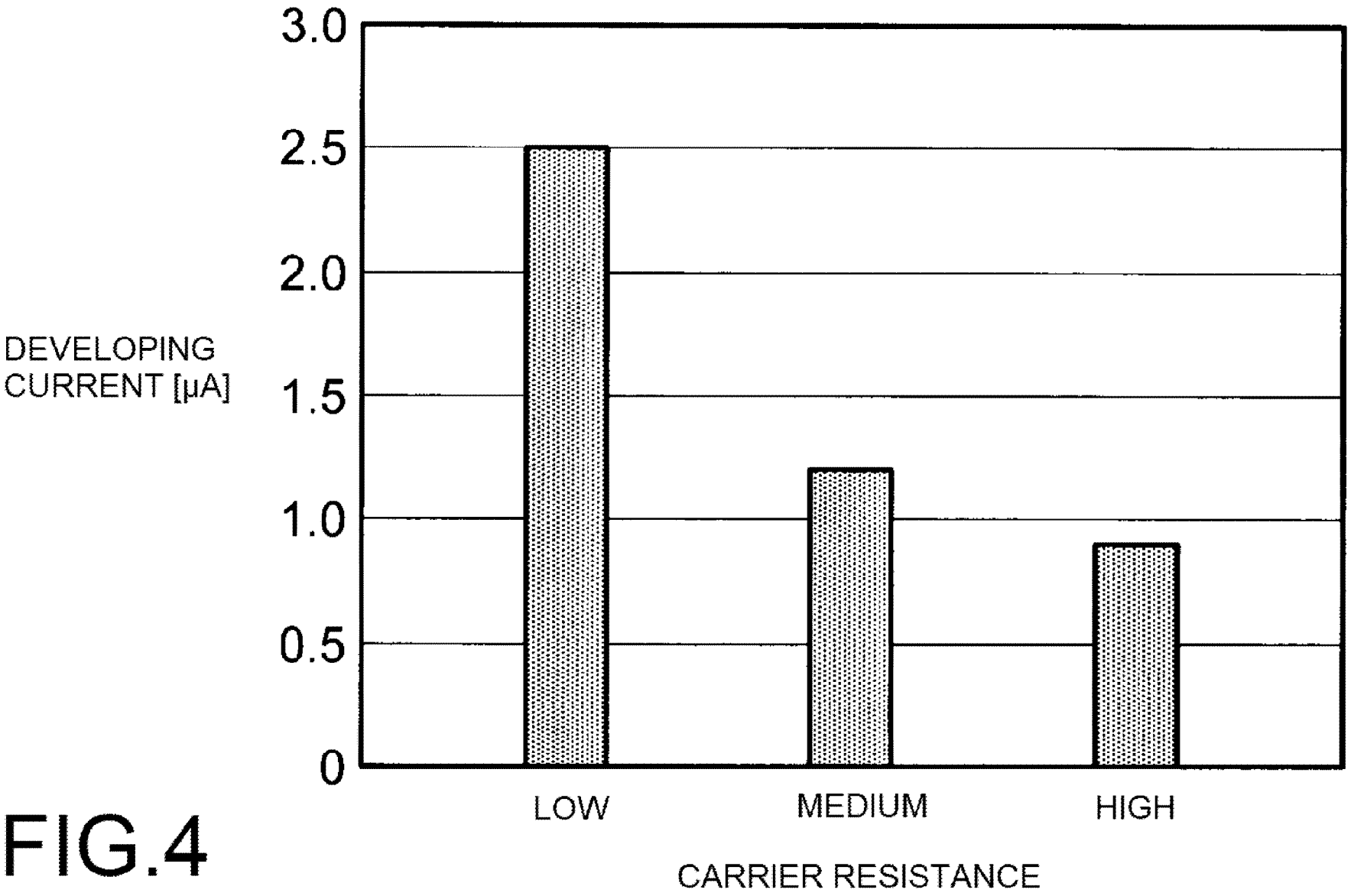
FIG. 4 is a graph illustrating the relationship between the carrier resistance and the developing current of an image forming apparatus of an embodiment according to the present disclosure.

FIG. 4 is a graph illustrating the relationship between the carrier resistance and the developing current. The horizontal axis of the graph of FIG. 4 indicates three levels (low, medium, and high) according to the magnitude of carrier resistance, and the vertical axis indicates the developing current.

The magnitude of the developing current is affected by the level of carrier resistance. According to FIG. 4, the higher the carrier resistance level, the smaller the developing current. As a result, the carrier resistance of the developing current may be derived by detecting the developing current by the current detecting unit 13 and converting from the current value of the detected developing current. For example, the control unit 8 is able to derive the carrier resistance based on the developing current detected by the current detecting unit 13 by storing a table or the like corresponding to the graph of FIG. 4 in the storage unit 9 or the like in advance, and using that table.

Figure 5:
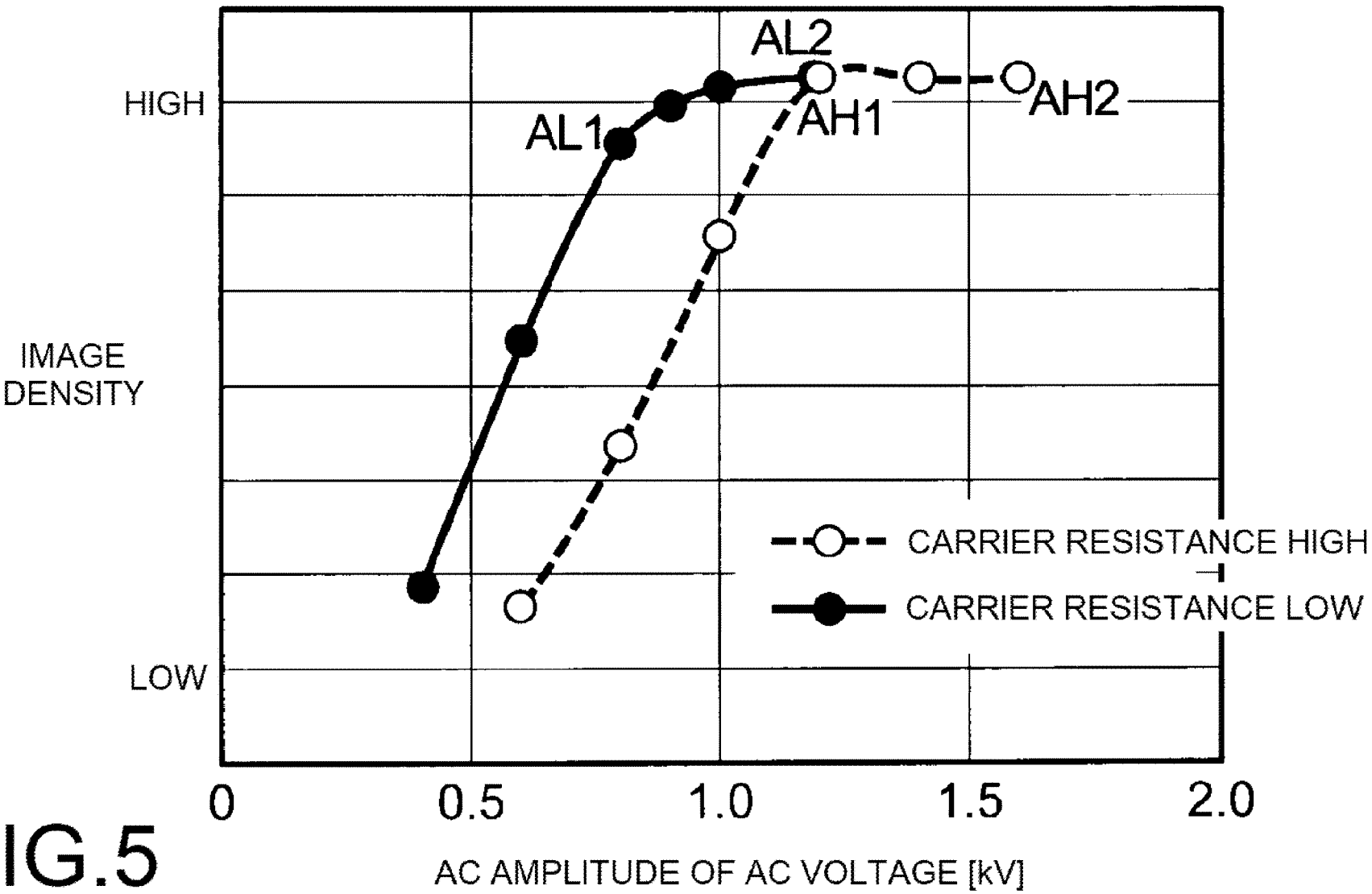
FIG. 5 is a graph illustrating the relationship between the AC amplitude of the AC voltage and the image density during development by the image forming apparatus of an embodiment according to the present disclosure.

FIG. 5 is a graph illustrating the relationship between the AC amplitude of the AC voltage and the image density during development. The horizontal axis of the graph of FIG. 5 indicates the AC amplitude of the AC voltage during development, and the vertical axis indicates the image density. FIG. 5 illustrates the relationship between the AC amplitude of the AC voltage during development and the image density when the carrier resistance level is high (broken line) and when low (solid line).

The AC amplitude AL1 when the carrier resistance is at a high level and the AC amplitude AL1 when the carrier resistance is at a low level indicate the image density saturation voltage, respectively. In a case where the AC amplitude of the AC voltage during development is less than the image density saturation voltage, image defects such as image unevenness in a solid image, for example, may occur. Therefore, the AC voltage during development needs to be set to an AC amplitude equal to or higher than the image density saturation voltage at which the image density is stable.

The AC amplitude AH2 in a case where the carrier resistance is at a high level and the AC amplitude AL2 when the carrier resistance is at a low level indicate the AC amplitude at which a leakage occurs on the surface of the photosensitive drum 21, respectively. The AC voltage during development needs to be set to an AC amplitude at which leakage does not occur on the surface of the photosensitive drum 21, but the AC amplitude varies depending on the level of the carrier resistance.

Therefore, for example, by storing a table or the like corresponding to the graph of FIG. 5 in the storage unit 9 or the like in advance and using the table, the control unit 8 controls the AC amplitude of the AC voltage based on the carrier resistance. With this configuration, for example, even in a case where the carrier resistance of the developer changes with the passage of time, the developing conditions may be controlled based on the carrier resistance. As a result, it is possible to deal with the difference in carrier resistance and suppress the occurrence of image defects such as image unevenness in a solid image. Therefore, it is possible to obtain high image quality.

Then, according to FIG. 5, the control unit 8 increases the AC amplitude of the AC voltage as the carrier resistance increases. According to this configuration, the developing conditions may be changed according to the difference in carrier resistance.

Even more specifically, the control unit 8 sets the AC amplitude of the AC voltage during development to a range that is equal to or higher than the image density saturation voltage and does not cause leakage on the surface of the photosensitive drum 21. For example, according to FIG. 5, in a case where the carrier resistance is at a high level, the AC amplitude of the AC voltage during development is set in a range of the AC amplitude AH1 or more of the image density saturation voltage and less than the AC amplitude AH2 at which leakage occurs on the surface of the photosensitive drum 21. Moreover, according to FIG. 5, in a case where the carrier resistance is at a low level, the AC amplitude of the AC voltage during development is set in the range of the AC amplitude AL1 or more of the image density saturation voltage and less than the AC amplitude AL2 where leakage occurs on the surface of the photosensitive drum 21. The range of AC amplitude of the AC voltage during development differs depending on the magnitude of the carrier resistance. With this configuration, regardless of the level of carrier resistance, it is possible, for example, to suppress the occurrence of image defects such as image unevenness in a solid image, and suppress the occurrence of leakage to the surface of the photosensitive drum 21.

Then, the control unit 8 executes the detection of the developing current by the current detecting unit 13 by using the non-exposure region of the photosensitive drum 21 at the time of non-image formation. With this configuration, a white background region in which the toner does not fly is used during non-image formation, so the developing current does not include the toner transfer current but includes only the carrier current. Therefore, it is possible to improve the accuracy of deriving the carrier resistance based on the developing current detected by the current detecting unit 13.

Figure 6:
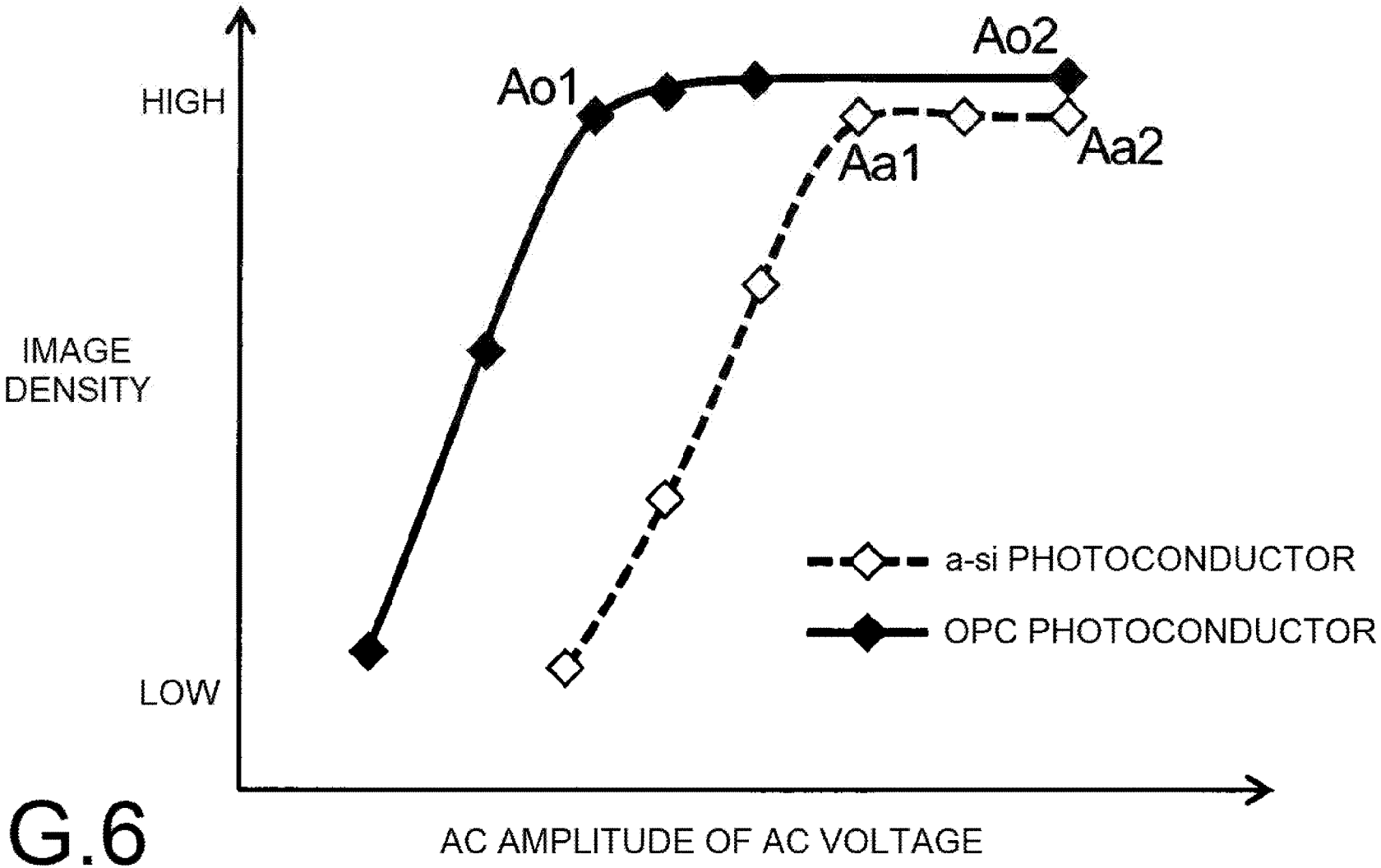
FIG. 6 is a graph illustrating the relationship between the AC amplitude of the AC voltage during development and the image density of each of an amorphous silicon photoconductor and an organic photoconductor.

FIG. 6 is a graph illustrating the relationship between the AC amplitude and the image density of the AC voltage during development of each of the amorphous silicon photoconductor (a-Si) and the organic photoconductor (OPC). The horizontal axis of the graph of FIG. 6 indicates the AC amplitude of the AC voltage during development, and the vertical axis indicates the image density. An example of the level of the carrier resistance in each photoconductor is illustrated.

According to FIG. 6, the range of Ao1 or more and less than Ao2 of the OPC photoconductor is wider than the range of Aa1 or more and less than Aa2 of the amorphous silicon photoconductor. Ao1 is the AC amplitude of the image density saturation voltage of the AC voltage during development in the case of the OPC photoconductor. Ao2 is the AC amplitude at which leakage occurs on the surface of the photosensitive drum. Aa1 is the AC amplitude of the image density saturation voltage of the AC voltage during development. Aa2 is the AC amplitude at which a leakage occurs on the surface of the photosensitive drum. Then, in the case of an OPC photoconductor, the range in which the AC amplitude of the AC voltage during development is equal to or higher than the image density saturation voltage and no leakage occurs on the surface of the photosensitive drum includes portions that overlap even when the carrier resistance of the developer is different. Therefore, in the case of an OPC photoconductor, when the AC amplitude of the AC voltage is set in the overlapping portion, it is not necessary to control the AC amplitude of the AC voltage based on the carrier resistance.

As described above, the photosensitive layer of the photosensitive drum 21 of the present embodiment is an amorphous silicon photosensitive layer. In the case of an amorphous silicon photoconductor, the range in which the AC amplitude of the AC voltage during development is equal to or higher than the image density saturation voltage and leakage does not occur on the surface of the photosensitive drum differs depending on the level of the carrier resistance. Therefore, in the case of an amorphous silicon photoconductor, it is necessary to control the AC amplitude of the AC voltage based on the carrier resistance. As a result, the occurrence of image defects can be suppressed, and high image quality may be obtained.

Although the embodiments of the present disclosure have been described above, the scope of the present disclosure is not limited to this, and it can be implemented with various modifications without departing from the gist of the disclosure.

For example, the table corresponding to FIG. 4, for example, for deriving the carrier resistance based on the developing current and the table corresponding to FIG. 5, for example, for controlling the AC amplitude of the AC voltage based on the carrier resistance may be replaced with calculation formulas or the like. It is desirable that these tables and calculation formulas are constructed based on carrier resistance information of the developer at the time of manufacture and information reflecting the relationship between the AC amplitude of the AC voltage and the image density.

Moreover, in the embodiment described above, the image forming apparatus 1 is a so-called tandem type image forming apparatus for color printing that sequentially superimposes and forms images of a plurality of colors. However, the image forming apparatus 1 is not limited to such a model, and may be an image forming apparatus for color printing or an image forming apparatus for monochrome printing that is not a tandem type.

In a typical technique, in a case where the AC amplitude of the AC voltage during development is insufficient, for example, in the development of a solid image, image unevenness (pitch unevenness) in which lights and shades are continuous in the circumferential direction of the photosensitive drum may occur. On the other hand, in the developing unit, in order to realize a stable developing operation, the developer is conveyed while stirring in the developing unit. As a result, when a two-component developer that includes a toner and a magnetic carrier is used, the carrier resistance of the developer may differ with the passage of time. Then, in developing a solid image, there is a problem in that the conditions for the occurrence of image unevenness differ depending on the magnitude of the carrier resistance.

In view of the situation described above, the object according to the present disclosure is to provide an image forming apparatus capable of suppressing the occurrence of image defects in response to a difference in carrier resistance and obtaining high image quality.

With the configuration according to the present disclosure, for example, the developing conditions may be controlled based on the carrier resistance even in a case where the carrier resistance of the developer changes with the passage of time. As a result, it is possible to deal with the difference in carrier resistance and suppress the occurrence of image defects such as image unevenness in a solid image. Therefore, it is possible to obtain high image quality.

The technique according to the present disclosure may be applied to an image forming apparatus.

What is claimed is:

1. An image forming apparatus comprising:

an image carrier having a photosensitive layer and an electrostatic latent image being formed on a surface thereof, a charging unit that charges the surface of the image carrier;

a developing unit having a developer carrier that carries toner in a two-component developer that includes a toner and a magnetic carrier on a surface thereof, and forms a toner image by adhering the toner to the electrostatic latent image that is formed on the image carrier;

a developing power supply that applies a developing voltage obtained by superimposing an AC voltage on a DC voltage to the developer carrier;

a current detecting unit that detects a developing current that flows between the developer carrier and the image carrier when the developing voltage is applied to the developer carrier; and a control unit that controls operation of the image carrier, the charging unit, the developing unit, and the developing power supply; wherein the control unit causes the charging unit to charge the surface of the image carrier, and when the developing voltage is applied to the developer carrier by the developing power supply, derives a carrier resistance based on the developing current detected by the current detecting unit, and controls an AC amplitude of the AC voltage based on the carrier resistance.

2. The image forming apparatus according to claim 1, wherein the control unit increases the AC amplitude as the carrier resistance increases.

3. The image forming apparatus according to claim 2, wherein the control unit sets the AC amplitude in a range that is equal to or higher than an image density saturation voltage at which leakage does not occur on the surface of the image carrier.

4. The image forming apparatus according to claim 1, wherein the control unit executes detection of the developing current by the current detecting unit by utilizing a non-exposed region of the image carrier during non-image formation.

5. The image forming apparatus according to claim 1, wherein the photosensitive layer of the image carrier is an amorphous silicon photosensitive layer.

* * * * *